US007338035B2

(12) United States Patent
Tsai

(10) Patent No.: US 7,338,035 B2
(45) Date of Patent: Mar. 4, 2008

(54) FOUNDATION SHOCK SUPPRESSOR

(76) Inventor: Chong-Shien Tsai, 6F-2, No. 5, Lane 466, Minchuan Rd., North Dist., Taichung (TW)

( * ) Notice: Subject to any disclaimer, the term of this patent is extended or adjusted under 35 U.S.C. 154(b) by 188 days.

(21) Appl. No.: 11/008,550

(22) Filed: Dec. 9, 2004

(65) Prior Publication Data

US 2006/0125161 A1 Jun. 15, 2006

(51) Int. Cl.
*E04B 1/98* (2006.01)

(52) U.S. Cl. ..... 267/136; 52/167.1; 52/167.4

(58) Field of Classification Search ..... 267/136, 267/140.11, 140.5; 52/167.1, 167.4, 167.5; 248/562, 569
See application file for complete search history.

(56) References Cited

U.S. PATENT DOCUMENTS 1,945,595 A * 2/1934 Chilton ..... 267/269
6,164,022 A * 12/2000 Ishikawa et al. ..... 52/167.5
6,725,612 B2 * 4/2004 Kim ..... 52/167.5

FOREIGN PATENT DOCUMENTS

JP 5812241 A * 1/1983
JP 960336 A * 3/1997
JP 11210821 A * 8/1999
JP 2001227196 A * 8/2001

* cited by examiner

*Primary Examiner*—Melody M. Burch
(74) *Attorney, Agent, or Firm*—Alan Kamrath; Kamrath & Associates PA

(57) ABSTRACT

A shock suppressor has at least two sliding units stacked in an alternate manner, and each sliding unit consists of a moving base, a connecting base and at least one rod. The connecting base is moveably combined with the moving base via the at least one rod. At least one positioning hole and at least one curved guiding channel are defined respectively in the connecting base and moving base for the at least one rod to be mounted respectively in the at least one positioning hole and to extend moveably into a corresponding one of the at least one guiding channel. Accordingly, the shock suppressor can reduce or isolate the transmission of a shock efficiently.

35 Claims, 10 Drawing Sheets

FOUNDATION SHOCK SUPPRESSOR

BACKGROUND OF THE INVENTION

1. Field of the Invention

The present invention relates to a suppressor for a building or sensitive equipment and, more particularly, to a foundation shock suppressor that can dissipate seismic shock energy efficiently 2. Description of Related Art In recent years, the trend for constructing taller and taller buildings has gathered pace. However, the effect of ground motion is a very important factor to be considered in the design of a high building or a skyscraper, from micro-vibrations to catastrophic earthquakes, such as in Taiwan or Japan. Therefore, shock reduction is a very important aspect in the construction of a building or a skyscraper.

In addition, to protect cultural or historical relics, industrial precision instruments, etc., a shock suppressing device is always needed. To overcome the shortcomings, the present invention tends to provide a foundation shock suppressor to mitigate or obviate the aforementioned problems.

SUMMARY OF THE INVENTION

The main objective of the invention is to provide a shock suppressor that can reduce or isolate the transmission of a shock efficiently. The shock suppressor has at least two sliding units stacked in an alternate manner, and each sliding unit comprises a moving base, a connecting base and at least one rod. The connecting base is moveably combined with the moving base with the at least one rod. At least one positioning hole and at least one curved guiding channel are defined, respectively, in the moving base and connecting base. The at least one rod is mounted, respectively, in and is fully surrounded by the at least one positioning hole and extends moveably into and is fully surrounded by a corresponding one of the at least one corresponding guiding channel.

Other objectives, advantages and novel features of the invention will become more apparent from the following detailed description when taken in conjunction with the accompanying drawings.

DETAILED DESCRIPTION OF PREFERRED EMBODIMENT

Figure 1:
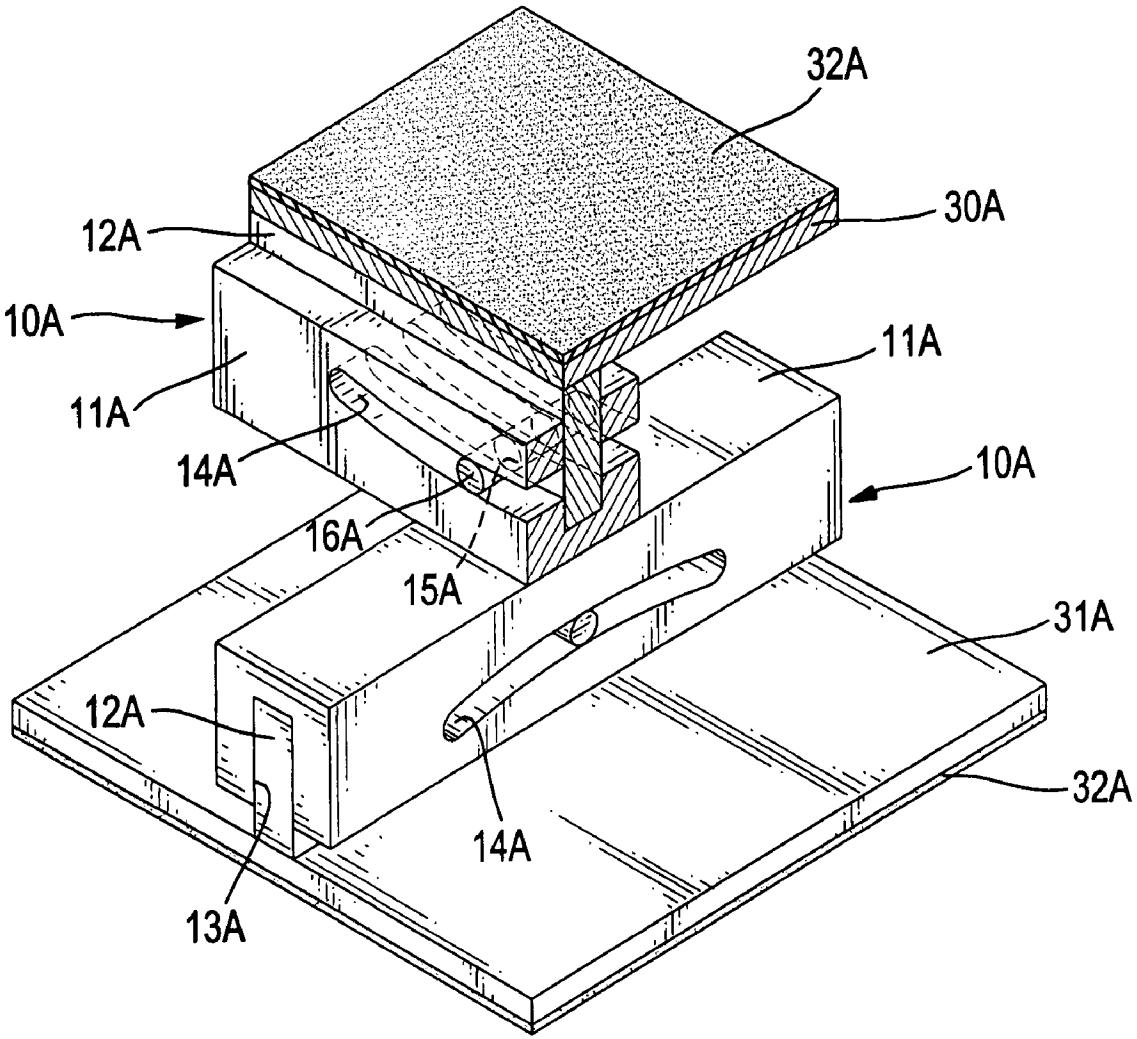
FIG. 1 is a perspective view in partial cross section of a first embodiment of a foundation shock suppressor in accordance with the present invention.

With reference to FIG. 1, a first embodiment of a shock suppressor in accordance with the present invention comprises two sliding units (10A) stacked with each other at an angle, such as perpendicular. Each sliding unit (10A) comprises a moving base (11A), a connecting base (12A) and a rod (16A). The moving base (11A) has a longitudinal recess (13A) defined in a first side of the moving base (11A) whereby the cross section of the moving base (11A) is U-shaped. The moving base (11A) further has a curved guiding channel (14A) defined through the moving base (11A) and communicating with the longitudinal recess (13A). The curved guiding channel (14A) has a middle portion away from the first side of the moving base (11A) defining the longitudinal recess (13A).

The connecting base (12A) is moveably combined with the moving base (11A) via the rod (16A). In a preferred embodiment, the connecting base (12A) is moveably received in the longitudinal recess (13A) in the moving base (11A). The connecting base (12A) has a positioning hole (15A) defined in the connecting base (12A) and corresponding to the guiding channel (14A) in the moving base (11A). The rod (16A) is rotatably mounted inside the positioning hole (15A) in the connecting base (12A) and extends into the guiding channel (14A) in the moving base (11A), such that the connecting base (12A) is moveable relative to the moving base (11A).

In the first embodiment, the sliding units (10A) are combined with each other via the moving bases (11A) at a side away from the longitudinal recess (13A). In an alternative embodiment, the connecting base (12A) of the upper sliding unit (10A) is securely connected with the moving base (11A) of the lower sliding unit (10A) to combine the sliding units (10A) in a different way.

In addition, a top base (30A) is securely attached to the connecting base (12A) of the upper sliding unit (10A), and a bottom base (31A) is securely attached to the connecting base (12A) of the lower sliding unit (10A). A coating (32A) made of adhesive material is mounted on at least one or both of the top and bottom bases (30A, 31A).

The shock suppressor can be mounted between a foundation, such as the ground and an object, such as a building with the connecting base (12A) or moving base (11A) of the sliding units (10A) or with the top and bottom bases (30A, 31A). With such a shock suppressor, the connecting base (12A) of the lower sliding unit (10A) will move relative to the moving base (11A) when a shock occurs. With the engagement between the guiding channel (14A) and the rod (16A), the moving base (11A) will be slightly lifted relative to the connecting base (12A) but will not move with the connecting base (12A) while the rod (16A) moves along the curved guiding channel (14A). Because the sliding units (10A) are stacked with each other at an angle, a horizontal shock with multiple directions can be efficiently reduced or dissipated so that the shock will not be transmitted to the object supported on the shock suppressor. With the arrangement of the adhesive coatings (32A) on the top and bottom base (30A,31A), vertical shock can also be efficiently suppressed.

When the shock has stopped, the rods (16A) will automatically move to rest again in the middle portion of the curved guiding channels (14A) due to the weight of the sliding units (10A) and the supported object, such that the shock suppressor has an automatic positioning effect to an original status.

Figure 2:
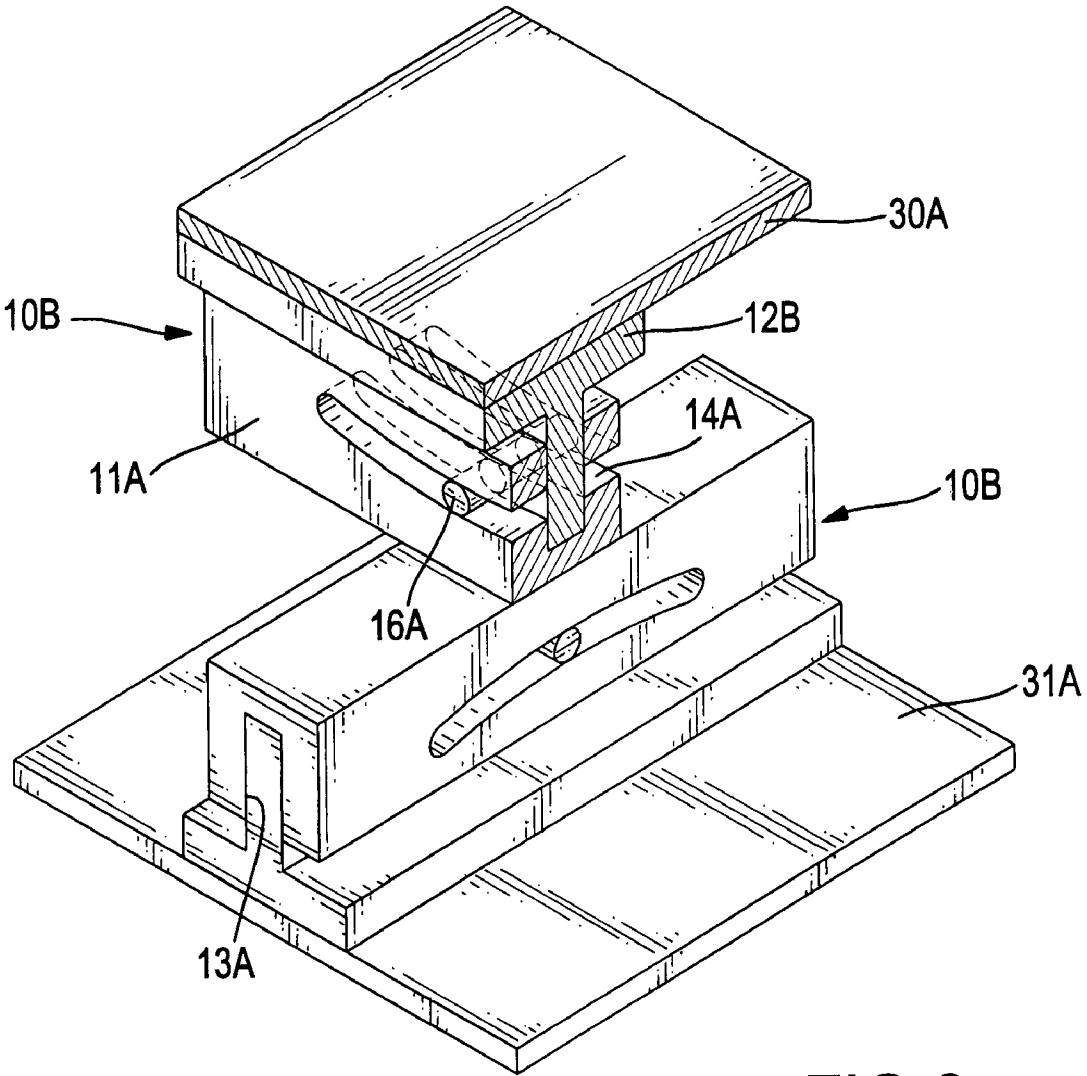
FIG. 2 is a perspective view in partial cross section of a second embodiment of a foundation shock suppressor in accordance with the present invention.

With reference to FIG. 2, a second embodiment of a shock suppressor in accordance with the present invention has a structure the same as that of the first embodiment except that the sliding units 10B include a connecting base (12B) having a T-shaped cross section. The middle portion of the T-shaped connecting base (12B) extends into the longitudinal recess (13A) in the corresponding moving base (11A).

Figure 3:
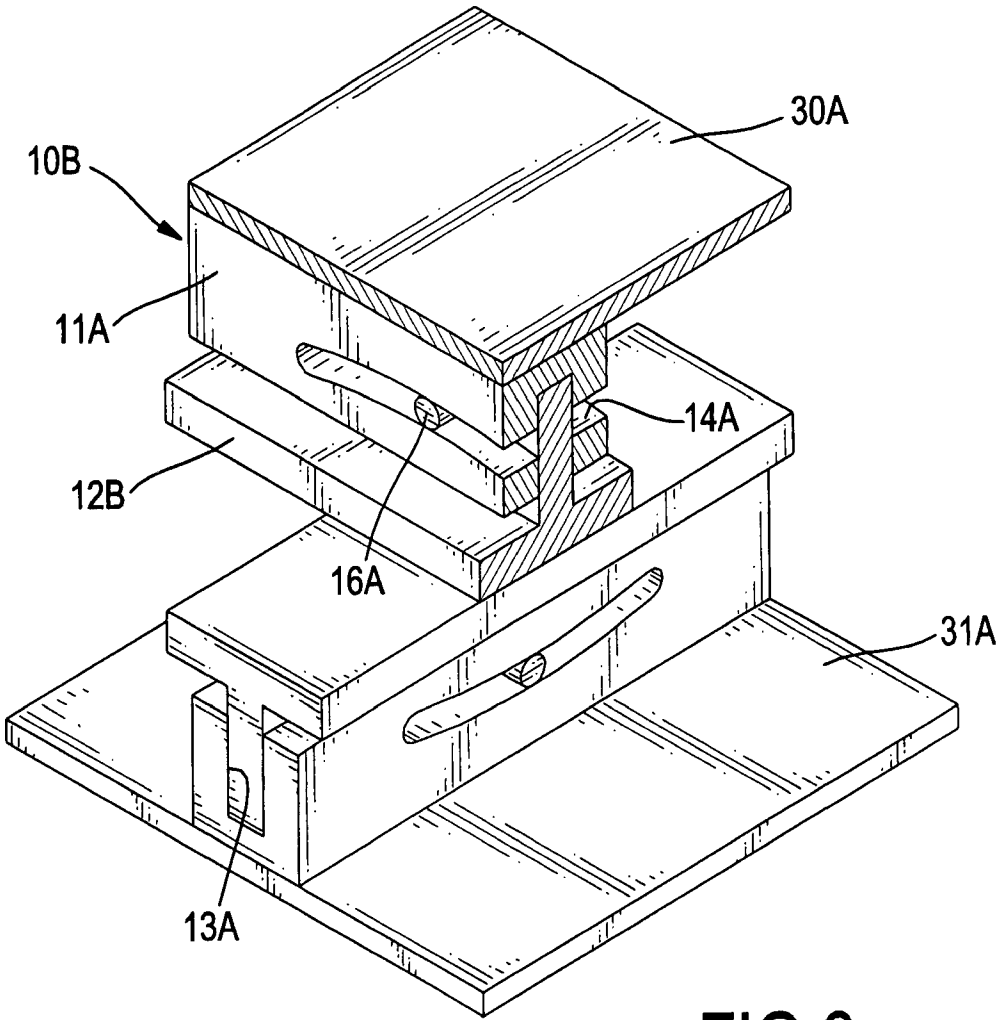
FIG. 3 is a perspective view in partial cross section of a third embodiment of a foundation shock suppressor in accordance with the present invention.

With reference to FIG. 3, a third embodiment of a shock suppressor in accordance with the present invention comprises two sliding units (10B) combined with each other via the connecting bases (12B). The moving bases (11A) of the sliding units (10B) are attached respectively to a top base (30A) and a bottom base (31A) at a second side far away from the longitudinal recess (13A).

Figure 4:
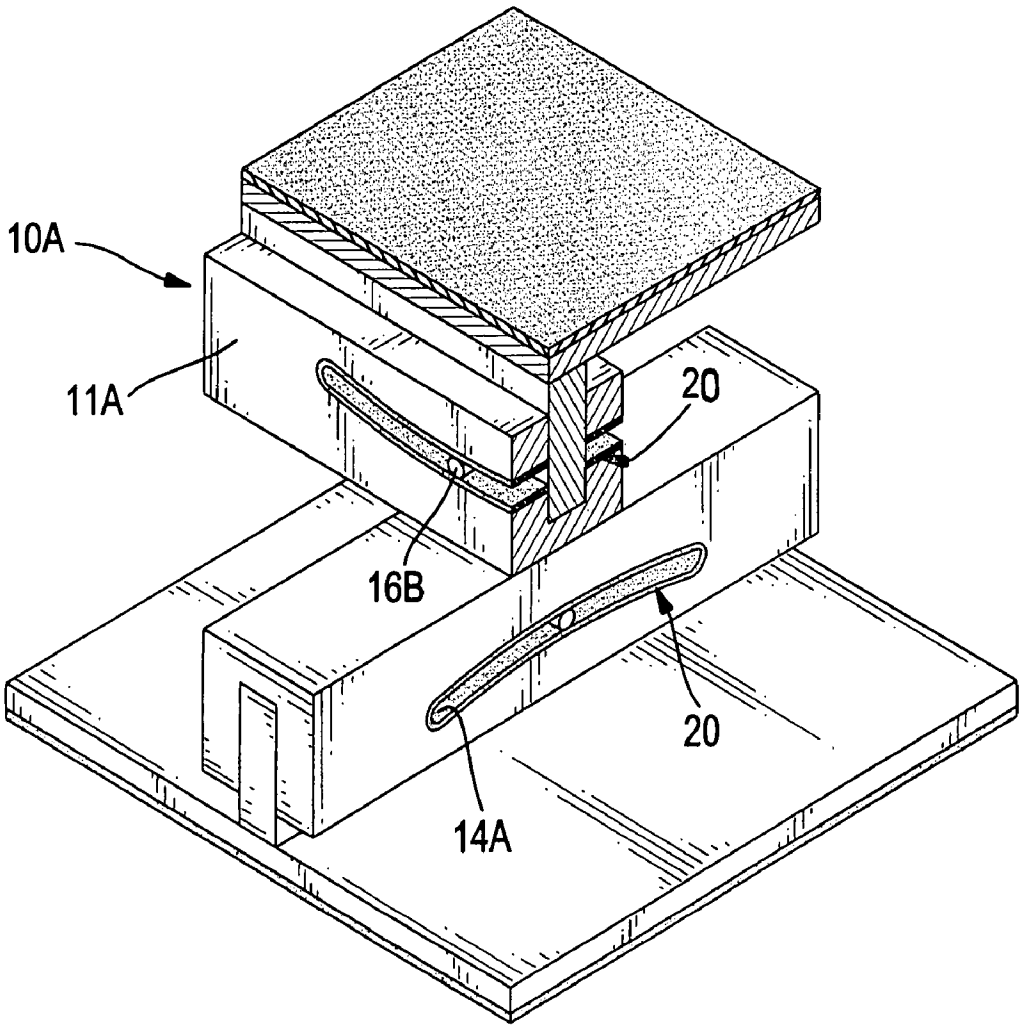
FIG. 4 is a perspective view in partial cross section of a fourth embodiment of a foundation shock suppressor in accordance with the present invention.

With reference to FIG. 4, a fourth embodiment of a shock suppressor in accordance with the present invention further comprises a shock suppressing element arranged in each sliding unit (10A). In the fourth embodiment, the shock suppressing element comprises a coating (20) made of adhesive material and attached to an inner surface of the guiding channel (14A) in the moving base (11A). The rod (16B) extending into the guiding channel (14A) abuts against the coating (20) and has a smaller diameter than that of the rod (16A) as shown in FIG. 1.

Figure 5:
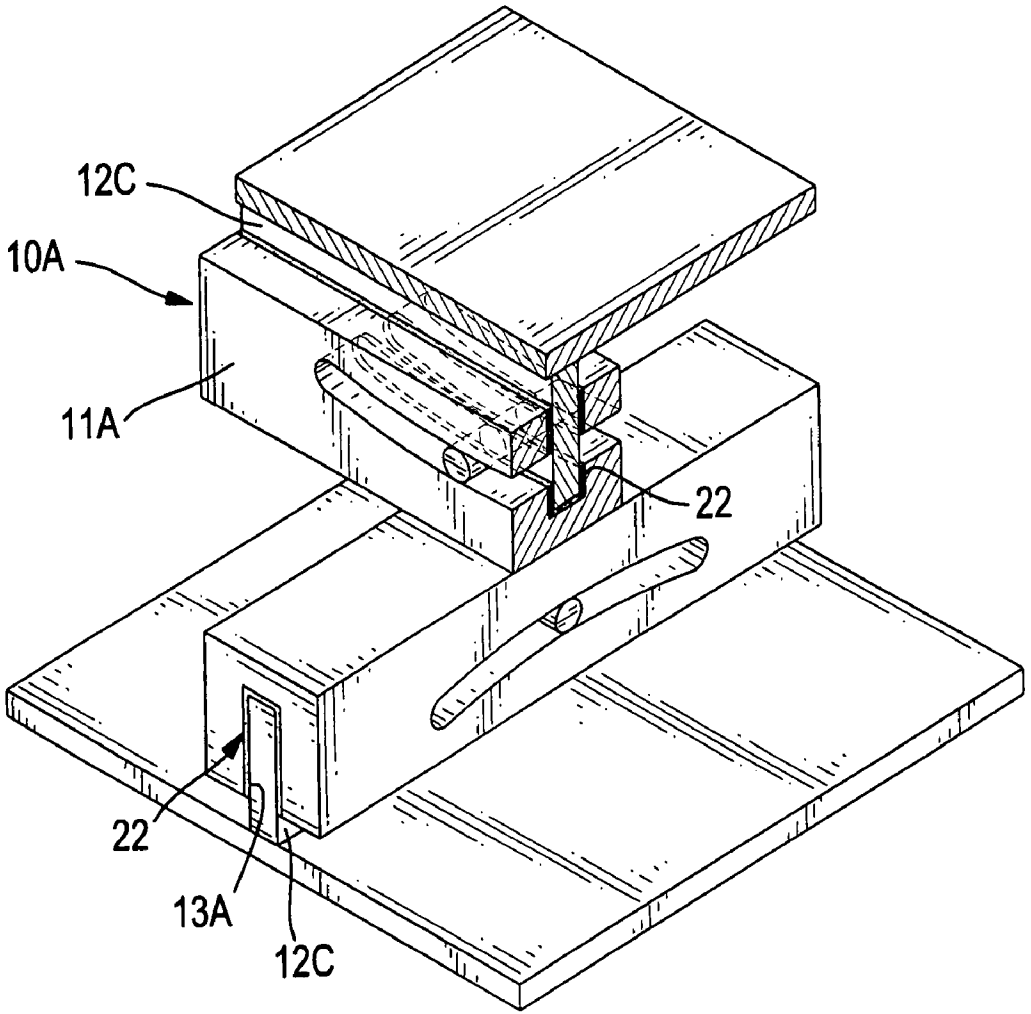
FIG. 5 is a perspective view in partial cross section of a fifth embodiment of a foundation shock suppressor in accordance with the present invention.

With reference to FIG. 5, the shock suppressing element of each sliding unit (10A) comprises a coating (22) made of adhesive material and attached to an inner surface of the longitudinal recess (13A) in the moving base (11A). The connecting base (12C) extending into the longitudinal recess (13A) abuts against the coating (22) and has a thickness smaller than that of the connecting base (12A) shown in FIG. 1.

Figure 6:
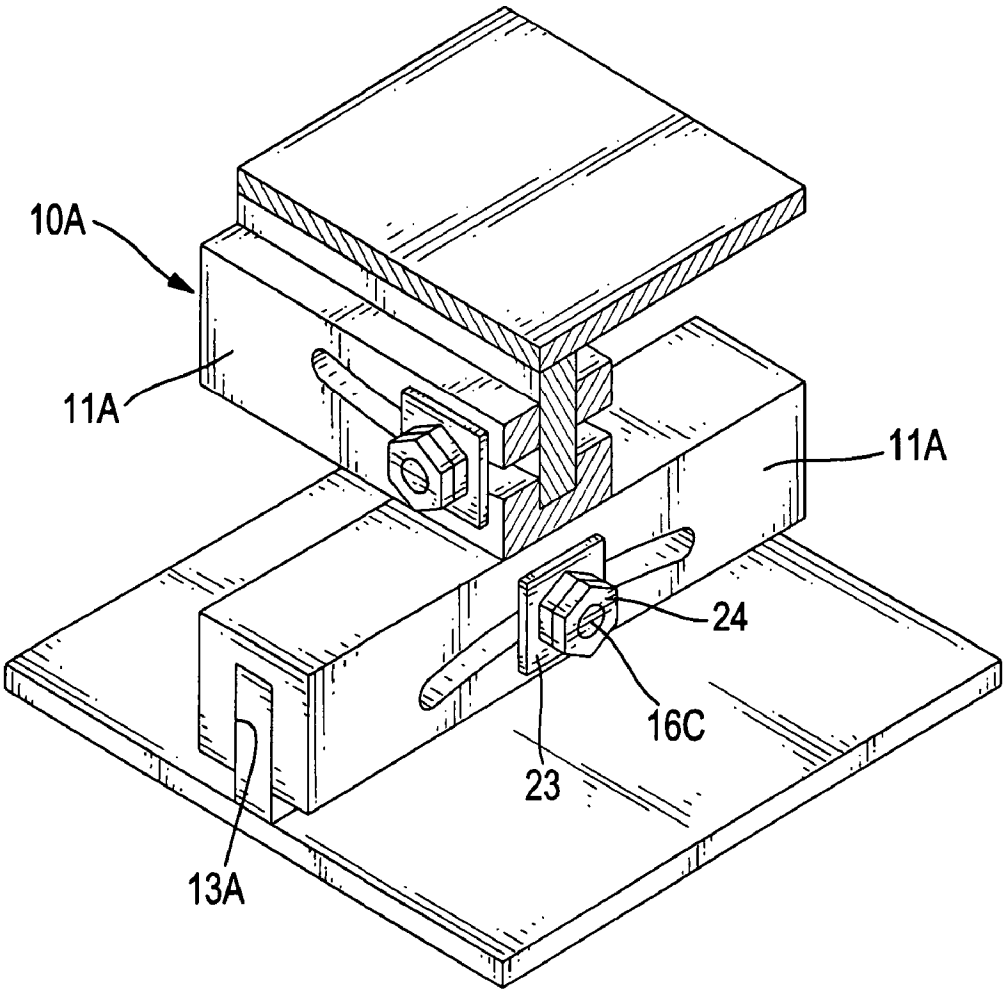
FIG. 6 is a perspective view in partial cross section of a sixth embodiment of a foundation shock suppressor in accordance with the present invention.

With reference to FIG. 6, the shock suppressing element of each sliding unit (10A) comprises two resilient pads (23) attached respectively to two ends of the rod (16*c*) and abutting respectively two sides of the moving base (11A). Two nuts (24) are attached, respectively, to the ends of the rod (16*c*) to hold the resilient pads (23) in place.

Figure 7:
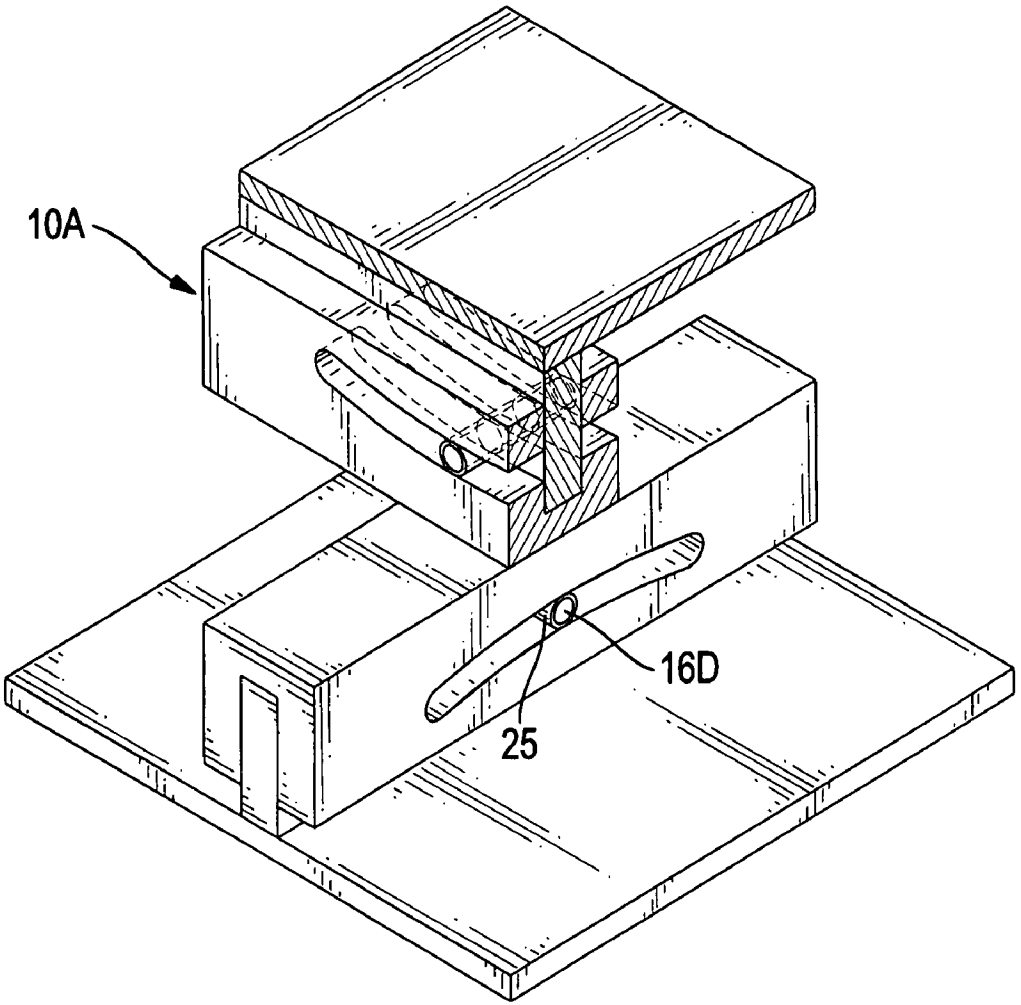
FIG. 7 is a perspective view in partial cross section of a seventh embodiment of a foundation shock suppressor in accordance with the present invention.

With reference to FIG. 7, the shock suppressing element of each sliding unit (10A) comprises a coating (25) made of adhesive material and attached to an outer surface of the rod (16*d*).

Furthermore, the shock suppressing elements as shown in FIGS. 4 to 7 can be applied to the different embodiments of the sliding units (10B) shown in FIGS. 2 and 3.

Figure 8:
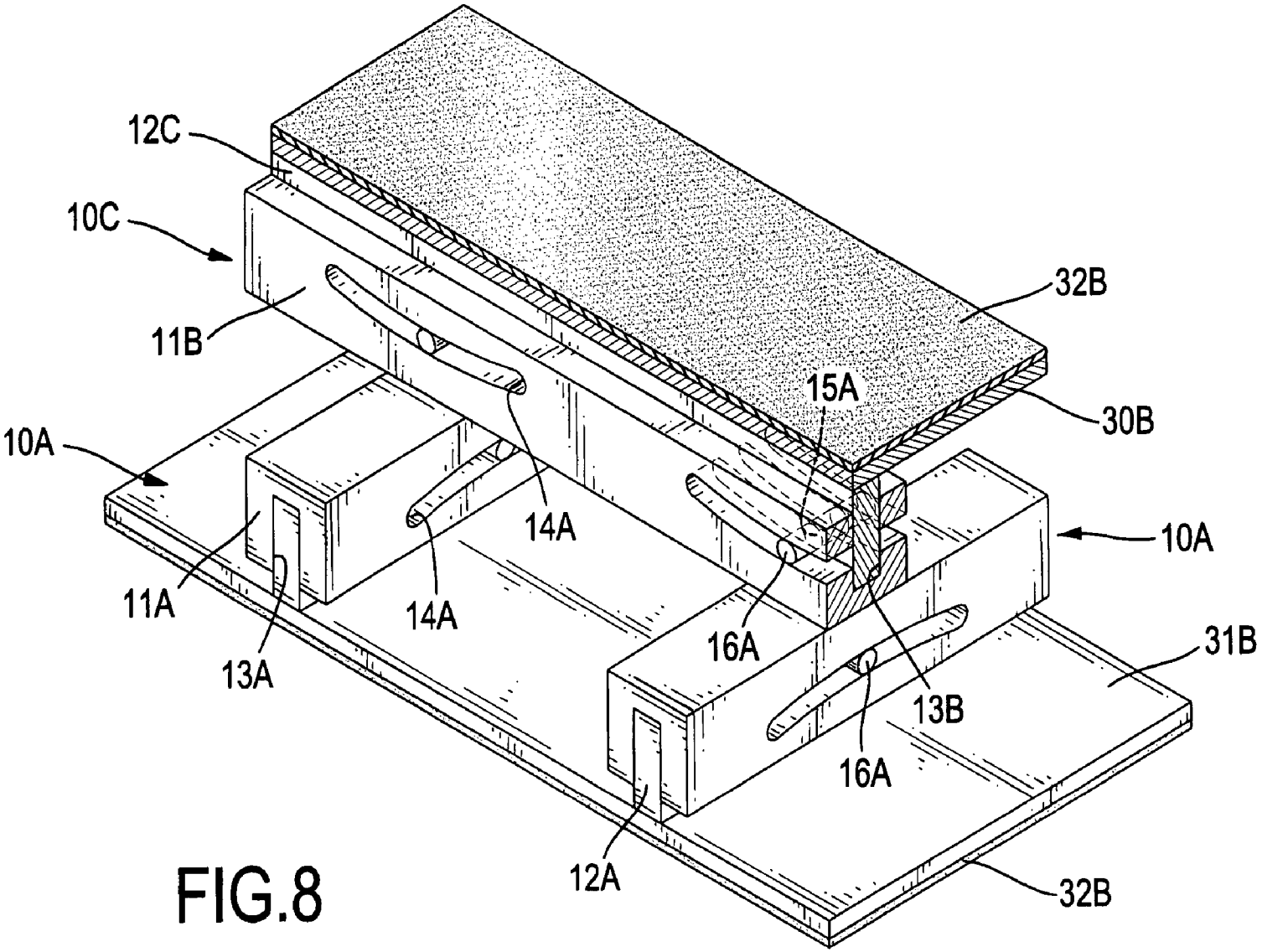
FIG. 8 is a perspective view in partial cross section of an eighth embodiment of a foundation shock suppressor in accordance with the present invention.

With reference to FIG. 8, an eighth embodiment of a shock suppressor in accordance with the present invention comprises three sliding units (10A,10A,10C) and arranged in two levels including a top level and a bottom level. The lower level comprises two of the sliding units (10A) and arranged in parallel with each other, and the top level comprises a single sliding unit (10C) stacked on the sliding units (10A) of the lower level and at an angle, preferably perpendicular.

The sliding unit (10C) of the upper level comprises a moving base (11B), a connecting base (12C) and two rods (16A). The moving base (11B) has two curved guiding channels (14A), and the rods (16A) are attached to the positioning holes (15A) in the connecting base (12C) and extend, respectively, into the guiding channels (14A) in the moving base (11B).

Each sliding unit (10A) of the lower level comprises a moving base (11A), a connecting base (12A) and a rod (16A). The moving base (11A) has a curved guiding channel (14A), and the rod (16A) is attached to the positioning hole (15A) in the connecting base (12A) and extends into the guiding channel (14A) in the moving base (11A).

A top base (30B) and a bottom base (31B) are attached, respectively, to the sliding unit (10C) of the upper level and the sliding units (10A) of the lower level. The top and the bottom bases (30B,31B), respectively, have a coating (32B) made of adhesive material to provide a shock suppressing effect in a vertical direction.

In an alternative embodiment, the moving base (11A) of each sliding unit (10A) of the lower level has two guiding channels (14A), and two rods (16A) are attached to two positioning holes (15A) in the connecting base (12A) and extend respectively into the guiding channels (14A) in the moving base (11A). In addition, the shock suppressing elements as shown in FIGS. 4 to 7 can also be applied to the shock suppressor shown in FIG. 8. Furthermore, the upper level may have two or more sliding units (10C) arranged in parallel, and the lower level may have three or more sliding units (10A) arranged in parallel.

Figure 9:
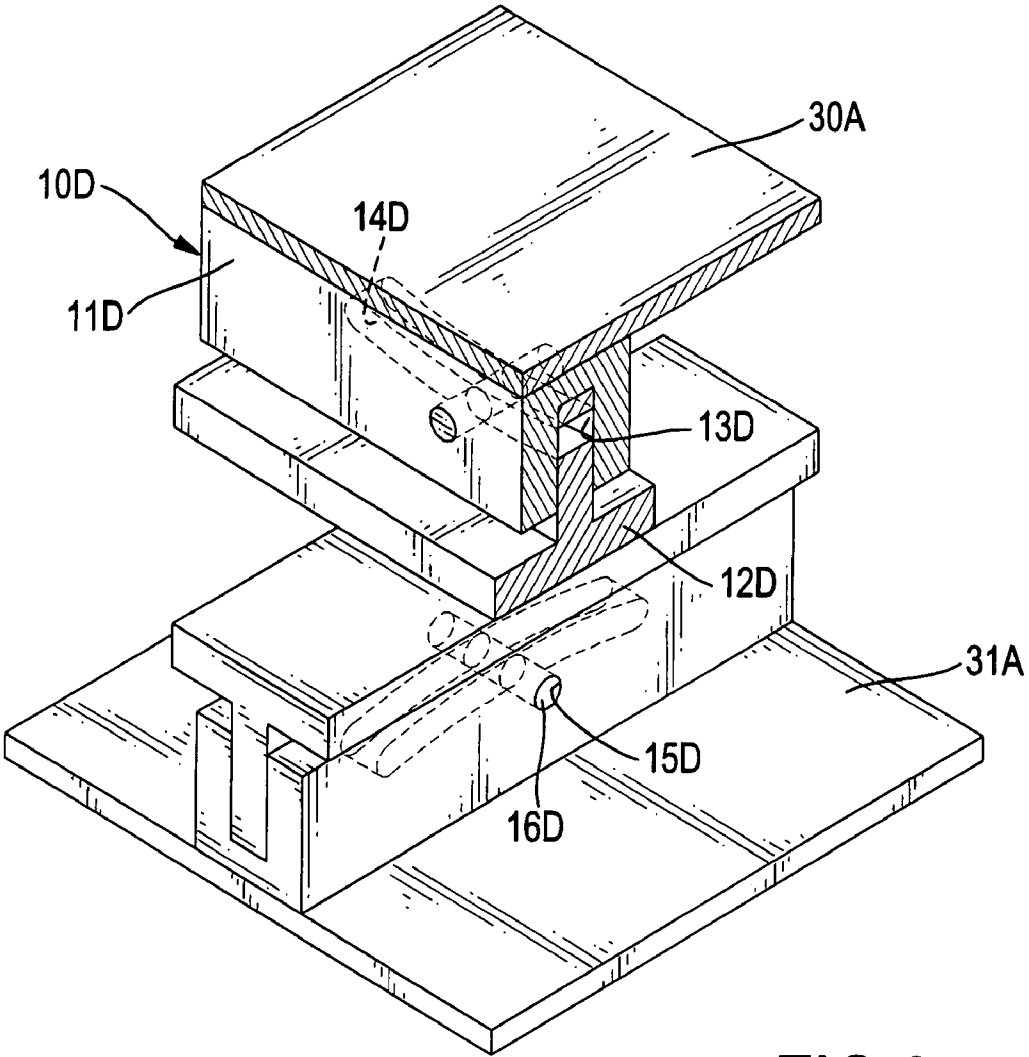
FIG. 9 is a perspective view in partial cross section of a ninth embodiment of a foundation shock suppressor in accordance with the present invention.

With reference to FIG. 9, a ninth embodiment of a shock suppressor in accordance with the present invention comprises two sliding units (10D) stacked with each other at an angle. Each sliding unit (10D) comprises a moving base (11D), a connecting base (12D) and a rod (16D). The moving base (11D) has a longitudinal recess (13D) defined in one side of the moving base (11D) whereby the cross section of the moving base (11D) is U-shaped. The moving base (11D) further has a positioning hole (15D) communicating with the longitudinal recess (13D).

The connecting base (12D) is moveably combined with the moving base (11D) with the rod (16D). In a preferred embodiment, the connecting base (12D) has a T-shaped cross section. The connecting base (12D) has a curved guiding channel (14D) defined through the connecting base (12D) and corresponding to the positioning hole (15D) in the moving base (11D). The curved guiding channel (14D) has a middle portion adjacent to the side of the moving base (11D) defining the longitudinal recess (13D).

The rod (16D) is rotatably mounted inside the positioning hole (15D) in the moving base (11D) and extends into the guiding channel (14D) in the connecting base (12D), such that the connecting base (12D) is moveably combined with the moving base (11D) via the rod (16D).

Figure 10:
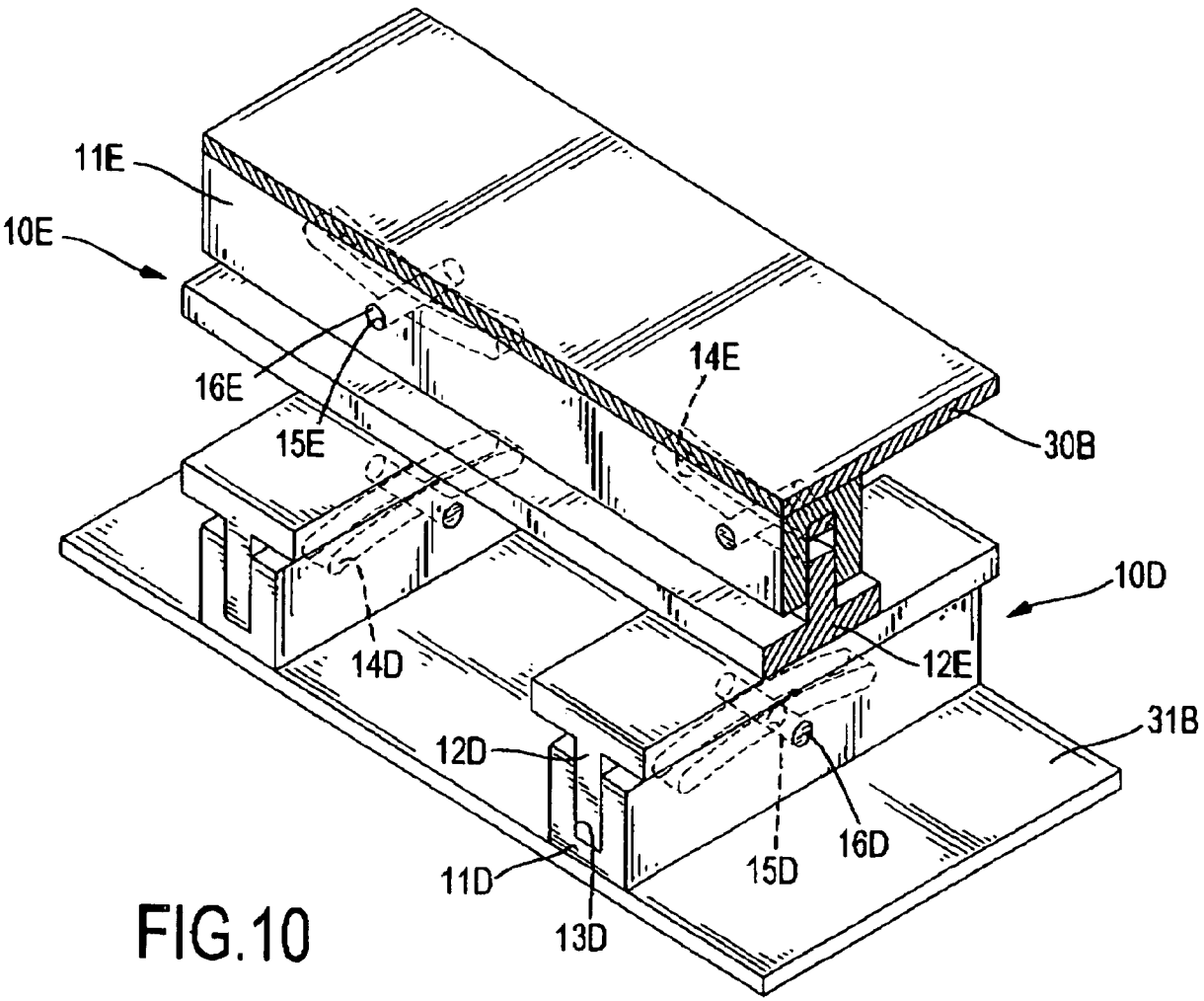
FIG. 10 is a perspective view in partial cross section of a tenth embodiment of a foundation shock suppressor in accordance with the present invention.

With reference to FIG. 10, a tenth embodiment of a shock suppressor in accordance with the present invention comprises three sliding units (10D, 10D, 10E) and arranged in two levels including a top level and a bottom level. The lower level comprises two of the sliding units (10D) and arranged in parallel with each other, and the top level is the single sliding unit (10E) stacked on the sliding units (10D) of the lower level at an angle.

The sliding unit (10E) of the upper level comprises a moving base (11E), a connecting base (12E) and two rods (16E). The moving base (11E) has two positioning holes (15E), and the connecting base (12E) has two curved guiding channels (14E) corresponding, respectively, to the positioning holes (15E) in the moving base (11E). The rods (16E) are attached, respectively, to the positioning holes (15E) in the moving base (11E) and extend, respectively, into the guiding channels (14E) in the connecting base (12E).

Each sliding unit (10D) of the lower level comprises a moving base (11D), a connecting base (12D) and a rod (16D). The moving base (11D) has a positioning hole (15D), and the connecting base (12D) has a curved guiding channel (14D) corresponding to the positioning hole (15D) in the moving base (11D). The rod (16D) is attached to the positioning hole (15D) in the moving base (11D) and extends into the guiding channel (14D) in the connecting base (12D). A top base (30B) and a bottom base (31B) are attached, respectively, to the sliding unit (10E) of the upper level and the sliding units (10D) of the lower level.

In an alternative embodiment, the connecting base (12D) of each sliding unit (10D) of the lower level has two guiding channels (14D), and two rods (16D) are attached to the moving base (11D) and extend, respectively, into the guiding channels (14D) in the connecting base (12D). In addition, the shock suppressing elements as shown in FIGS. 4 to 7 can also be applied to the shock suppressors shown in FIGS. 9 and 10. Furthermore, the upper level may have two or more sliding units (10E) arranged in parallel, and the lower level may have three or more sliding units (10D) arranged in parallel.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock suppressor comprising:

at least two sliding units stacked in an alternate manner, and each sliding unit comprising a moving base having a first side, a second side opposite and spaced from the first side, and a longitudinal recess extending from the first side towards but spaced from the second side, with the moving base having cross sections of a U-shape;

a connecting base longitudinally moveably received inside the longitudinal recess of the moving base;

at least one curved guiding channel formed in one of the moving base and the connecting base, with the at least one curved guiding channel extending longitudinally and communicating with the longitudinal recess;

at least one rod; and at least one positioning hole defined in another of the connecting base and the moving base, with the at least one positioning hole mounting the at least one rod, with the at least one rod-being mounted in and fully surrounded by the at least one positioning hole and extending moveably into and fully surrounded by the at least one curved guiding channel, with the at least one rod extending perpendicular to the longitudinal recess, with the connecting base within the longitudinal recess having cross sections perpendicular to the at least one rod.

2. The shock suppressor as claimed in claim 1, wherein the shock suppressor comprises two sliding units with the sliding units stacked with each other at an angle.

3. The shock suppressor as claimed in claim 2 further comprising a top base and a bottom base attached respectively to the sliding units.

4. The shock suppressor as claimed in claim 1 wherein the shock suppressor comprises at least three sliding units and arranged in two levels including a top level and a lower level;

the lower level comprises at least two of the at least three sliding units and arranged in parallel with each other in the lower level; and the top level comprises at least one of the at least three sliding units and stacked with the sliding units of the lower level at an angle.

5. The shock suppressor as claimed in claim 4 further comprising a top base and a bottom base attached respectively to the sliding units of the top level and the lower level.

6. The shock suppressor as claimed in claim 2, wherein the at least one curved guiding channel in each moving base has a middle portion and the longitudinal recess is defined in the moving base at the first side away from the middle portion of the at least one curved guiding channel; and the at least one rod is rotatably mounted inside a corresponding one of the at least one positioning hole in the connecting base, with the at least one curved guiding channel being spaced from the first and second sides when the connecting base is received inside the longitudinal recess of the moving base, with the cross sections of the connecting base being noncircular.

7. The shock suppressor as claimed in claim 4, wherein the at least one curved guiding channel in each moving base has a middle portion and the longitudinal recess is defined in the moving base at the first side away from the middle portion of the at least one curved guiding channel;

and the at least one rod is rotatably mounted inside a corresponding one of the at least one positioning hole in the connecting base, with the at least one curved guiding channel being spaced from the first and second sides when the connecting base is received inside the longitudinal recess of the moving base, with the cross sections of the connecting base being noncircular.

8. The shock suppressor as claimed in claim 1 further comprising a shock suppressing element arranged in each sliding unit.

9. The shock suppressor as claimed in claim 6 further comprising a shock suppressing element arranged in each sliding unit.

10. The shock suppressor as claimed in claim 7 further comprising a shock suppressing element arranged in each sliding unit.

11. The shock suppressor as claimed in claim 9, wherein the shock suppressing element of each sliding unit comprises two resilient pads attached respectively to two ends of each one of the at least one rod and abutting respectively with third and fourth sides of the moving base, with the third side being opposite from and spaced from the fourth side, with the third and fourth sides extending between the first and second sides.

12. The shock suppressor as claimed in claim 10, wherein the shock suppressing element of each sliding unit comprises two resilient pads attached respectively to two ends of each one of the at least one rod and abutting respectively with third and fourth sides of the moving base, with the third side being opposite from and spaced from the fourth side, with the third and fourth sides extending between the first and second sides.

13. The shock suppressor as claimed in claim 9, wherein the shock suppressing element of each sliding unit comprises an adhesive coating and attached to an inner surface of the longitudinal recess in the moving base.

14. The shock suppressor as claimed in claim 10, wherein the shock suppressing element of each sliding unit comprises an adhesive coating and the adhesive coating is attached to an inner surface of the longitudinal recess in the moving base.

15. The shock suppressor as claimed in claim 9, wherein the shock suppressing element of each sliding unit comprises an adhesive coating and the adhesive coating is attached to an inner surface of the at least one curved guiding channel in the moving base.

16. The shock suppressor as claimed in claim 10, wherein the shock suppressing element of each sliding unit comprises an adhesive coating and the adhesive coating is attached to an inner surface of the at least one curved guiding channel in the moving base.

17. The shock suppressor as claimed in claim 9, wherein the shock suppressing element of each sliding unit comprises an adhesive coating and the adhesive coating is attached to an outer surface of each one of the at least one rod.

18. The shock suppressor as claimed in claim 10, wherein the shock suppressing element of each sliding unit comprises an adhesive coating and the adhesive coating is attached to an outer surface of each one of the at least one rod.

19. The shock suppressor as claimed in claim 3 further comprising an adhesive coating and the adhesive coating is attached to each one of the top base and the bottom base.

20. The shock suppressor as claimed in claim 6 further comprising an adhesive coating and the adhesive coating is attached to at least one of the top base and the bottom base.

21. The shock suppressor as claimed in claim 7 further comprising an adhesive coating and the adhesive coating is attached to at least one of the top base and the bottom base.

22. The shock suppressor as claimed in claim 9 further comprising an adhesive coating and the adhesive coating is attached to at least one of the top base and the bottom base.

23. The shock suppressor as claimed in claim 10 further comprising an adhesive coating and the adhesive coating is attached to at least one of the top base and the bottom base.

24. The shock suppressor as claimed in claim 2, wherein the at least one curved guiding channel in each connecting base has a middle portion and the longitudinal recess is defined in the moving base at the first side adjacent to the middle portion of the guiding channel; and the at least one rod is rotatably mounted inside a corresponding one of the at least one positioning hole in the moving base, with the cross sections of the connecting base being noncircular.

25. The shock suppressor as claimed in claim 5, wherein the at least one curved guiding channel in each connecting base has a middle portion and the longitudinal recess is defined in the moving base at the first side adjacent to the middle portion of the guiding channel; and the at least one rod is rotatably mounted inside a corresponding one of the at least one positioning hole in the moving base, with the cross sections of the connecting base being noncircular.

26. The shock suppressor as claimed in claim 24 further comprising a shock suppressing element arranged in each sliding unit.

27. The shock suppressor as claimed in claim 25 further comprising a shock suppressing element arranged in each sliding unit.

28. The shock suppressor as claimed in claim 26, wherein the shock suppressing element of each sliding unit comprises an adhesive coating and the adhesive coating is attached to an inner surface of the longitudinal recess in the moving base.

29. The shock suppressor as claimed in claim 27, wherein the shock suppressing element of each sliding unit comprises an adhesive coating and the adhesive coating is attached to an inner surface of the longitudinal recess in the moving base.

30. The shock suppressor as claimed in claim 26, wherein the shock suppressing element of each sliding unit comprises an adhesive coating and the adhesive coating is attached to an inner surface of the at least one curved guiding channel in the connecting base.

31. The shock suppressor as claimed in claim 27, wherein the shock suppressing element of each sliding unit comprises an adhesive coating and the adhesive coating is attached to an inner surface of the at least one curved guiding channel in the connecting base.

32. The shock suppressor as claimed in claim 26, wherein the shock suppressing element of each sliding unit comprises an adhesive coating and the adhesive coating is attached to an outer surface of each one of the at least one rod.

33. The shock suppressor as claimed in claim 27, wherein the shock suppressing element of each sliding unit comprises an adhesive coating and the adhesive coating is attached to an outer surface of each one of the at least one rod.

34. The shock suppressor as claimed in claim 26, wherein the shock suppressing element of each sliding unit comprises two resilient pads attached respectively to two ends of each one of the at least one rod and abutting respectively with third and fourth sides of the moving base, with the third side being opposite from and spaced from the fourth side, with the third and fourth sides extending between the first and second sides.

35. The shock suppressor as claimed in claim 27, wherein the shock suppressing element of each sliding unit comprises two resilient pads attached respectively to two ends of each one of the at least one rod and abutting respectively with third and fourth sides of the moving base, with the third side being opposite from and spaced from the fourth side, with the third and fourth sides extending between the first and second sides.

* * * * *